United States Patent [19]

Lindsjö

[11] Patent Number: 4,570,788

[45] Date of Patent: Feb. 18, 1986

[54] PACKING CONTAINER WITH FOLD-OUT POURING SPOUT

[75] Inventor: Ulf J. M. Lindsjö, Lund, Sweden

[73] Assignee: Tetra Pak International AB, Lund, Sweden

[21] Appl. No.: 575,766

[22] Filed: Feb. 1, 1984

[30] Foreign Application Priority Data

Feb. 4, 1983 [SE] Sweden ..... 8300591

[51] Int. Cl.[4] ..... B65D 5/74

[52] U.S. Cl. ..... 229/17 R; 229/7 R

[58] Field of Search ..... 229/17 G, 37 R, 17 R, 229/7 R

[56] References Cited

U.S. PATENT DOCUMENTS

| | | | |
|---|---|---|---|
| 3,125,276 | 3/1964 | Zinn . | |
| 3,204,850 | 9/1965 | Wilcox | 229/17 G |
| 3,349,988 | 10/1967 | Horning | 229/17 G |
| 4,248,351 | 2/1981 | Berg | 229/17 R X |
| 4,433,784 | 2/1984 | Kjelgaard | 206/617 |

*Primary Examiner*—Allan N. Shoap
*Assistant Examiner*—Bryon Gehman
*Attorney, Agent, or Firm*—Burns, Doane, Swecker & Mathis

[57] ABSTRACT

Packing containers with fold-out pouring spout are used for a great number of beverages, e.g. milk. The pouring spout comprises a number of connected triangular wall panels which are delimited by folding lines. On opening, the pouring spout is folded out and the packing container is opened in that an outer end of the pouring spout is removed. To prevent the pouring spout from reverting to its folded-in condition after opening, the folding lines which delimit the material panel of the pouring spout from the upper side of the packing container are arranged so that they run at unequal angles. In this manner the breaking open and the forming of the pouring spout are facilitated.

19 Claims, 2 Drawing Figures

PACKING CONTAINER WITH FOLD-OUT POURING SPOUT

BACKGROUND AND SUMMARY OF THE INVENTION

The present invention relates to an arrangement on a packing container of the type which is of a substantially parallelepipedic main shape with a fold-out pouring spout that is delimited from an upper wall of the packing container by means of linear weakenings which extend in the direction from the corner of the pouring spout connected to the upper wall toward a sealing fin that runs centrally over the upper wall.

Packing containers for liquid contents, e.g., milk, juice or the like, are frequently manufactured at present from a flexible, semirigid packing laminate that comprises a carrier layer of fibrous material, e.g., paper, and outer, watertight layers of themoplastic material, usually polyethylene. The laminate is fed to a packaging machine in the form of a web or sheets and is folded, formed and sealed to produce a filled packing container of the desired, e.g., parallelepipedic, shape. A packing container of this main type is seen in Swedish Pat. No. 781822-8.

When the finished packing container is to be opened and the contents are to be poured out, a removable part at the upper end of the packing container is broken, torn or cut-off so that the contents become accessible. To facilitate the pouring out of the contents, the packing container frequently is also provided with some form of built-in pouring spout which can be folded out after the opening. The pouring spout usually comprises a number of triangular laminate panels which are connected to one another via weakening lines in the laminate. A part of the triangular pouring spout panels is also connected, inter alia, to the upper wall panel of the packing container from which the panels are again separated by means of weakening lines. The shape and the mutual placement of the different triangular pouring spout panels along with the presence of weakening lines between the panels and adjoining parts of the packing container proper, make it possible to form an effective pouring spout which allows emptying of the contents of the packing container in a collective jet. However, from the time of manufacture of the packing container the triangular pouring spout panels have been arranged in an inwardly folded position in accordance with the main shape of the packing container and have been retained in this position thereafter up to the opening of the packing container. Accordingly, the folding outward and forming of the pouring spout will offer a certain resistance. This resistance is a function of a number of different factors, such as the rigidity and flexibility of the packing laminate, the shape of the pouring spout panel and the adjoining wall panel, the strength of the weakening lines, the method of formation of the packing container, and the storage period. Under unfavorable circumstances, several of these factors may be jointly effective in a negative direction so that the outward turning and forming of the pouring spout becomes difficult to realize. These difficulties have been experienced in the prior art and it has been attempted to overcome these difficulties through a suitable choice of material and through selective strengthening and weakening of weakening lines so that a simpler and to some extent automatic outward folding of the pouring spout is obtained. This has been partly successful but involves at the same time various disadvantages which occur, in particular, during the handling and forming of the packing laminate into packing containers. It has been found, for example, that the required and more pronounced weakening lines easily lead to breaks in the laminate during formation, which breaks resulted in packing containers that leaked. A packing container of the main type described above is seen, e.g., in the Swedish Pat. No. 781822-8 mentioned earlier, to which reference is made.

It is an object of the present invention to provide a packing container with a fold-out pouring spout that is not subject to the disadvantages of the arrangements known previously.

It is a further object of the present invention to provide a packing container with a fold-out pouring spout that is simple to fold out and to form independent of the properties of the packing laminate chosen.

Finally, it is a further object of the present invention to provide a packing container with a fold-out pouring spout, which packing container is simple in principle to manufacture through the use of known methods and arrangements.

These and other objects have been achieved in accordance with the invention in that a packing container of the type described above has been given the characteristics that the weakening lines extend at unequal angles towards the sealing fin.

Owing to the special design of the weakening lines which delimit the fold-out pouring spout from the main part of the upper surface of the packing container, the unfolding of the crease lines is spread in time as the pouring spout is folded out so that the material is folded first along weakening lines of the one side and then along weakening lines of the other side. Thus, the packing laminate does not have to be folded open at the same time along weakening lines of both sides of the spout and no peak force arises which has proved to make easier the necessary bending or folding of the laminate. As a result of the asymmetric placing of the weakening lines the folding open of the material, moreover, will produce a pouring spout that is stronger and more durable. Consequentially, the prospect of the formed pouring spout collapsing is greatly diminished due to the flexibility and rigidity of the material.

BRIEF DESCRIPTION OF THE DRAWINGS

A preferred embodiment of the packing container in accordance with the invention will now be described in more detail with special reference to the enclosed schematic drawings.

DETAILED DESCRIPTION OF THE PREFERRED EMBODIMENT

Figure 1:
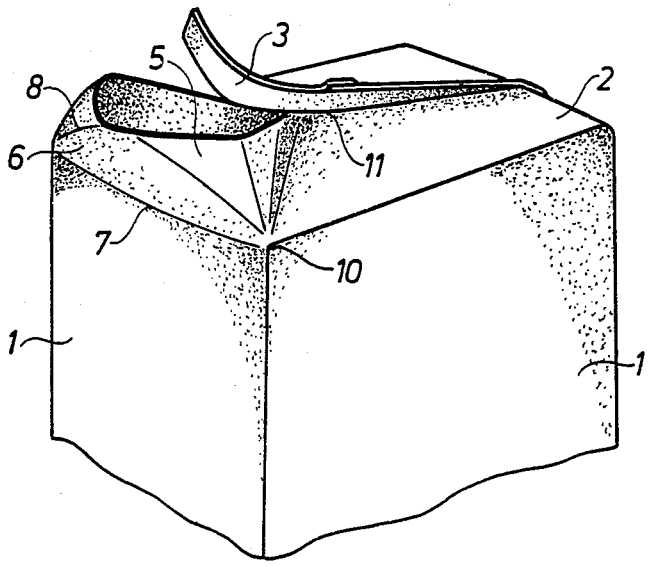
FIG. 1 shows in perspective the upper part of the packing container in accordance with the invention, in an opened condition and with the pouring spout folded out.

The packing container in accordance with the invention is of a parallelepipedic main shape with substantially plane side walls 1, an upper end wall 2 and a bottom wall which, however, is not visible on the drawing. The packing container is manufactured from the packing laminate mentioned in the introduction which laminate comprises a carrier layer of paper that is coated on both sides with polyethylene. The material is dimensionally relatively stable. In order to facilitate the folding necessary for the formation of the packing container, the laminate is provided with a number of folding or crease lines, some of which are visible on the drawing. The packing container is manufactured in accordance with the known procedure, that is the web-like packing laminate is, converted by folding into a tube which is then filled with the intended contents. Thereafter, the filled tube is flattened and sealed transversely in narrow zones extending transversely across the tube. After cutting through these transverse sealing zones, wholly filled, cushion-like packages are obtained which by means of form-processing are converted to packages of the parallelepipedic shape shown. The transverse sealing zone forms a sealing fin 3 which extends over the upper side 2 of the package. A corresponding sealing fin extends over the bottom wall of the packing container, but is not visible on the drawing. The sealing fin 3 is folded down during the formation of the packing container to rest against the upper end wall 2 of the packing container. When the wholly filled packing container is form-processed from cushion-shape to parallelepipedic shape, a surplus of material arises which is in the form of four triangular double-walled lugs 4 that are located at the corner portions of the packing container. Two of these four corner lugs are folded in and sealed to the bottom wall of the packing container (not shown) whereas the other two lugs are each sealed to a side wall 1. The lugs 4 comprise a part of the sealing fin 3, a part of two triangular spout panels 5 situated on either side of the sealing fin, which panels are connected with, and partly are also constituted of, material from the upper end wall 2 of the packing container, and a triangular panel 6 situated underneath the normally folded down part of the corner lug 4 (visible in FIG. 1 on the folded-up corner lug acting as a pouring spout) which panel constitutes a continuation of the side wall 1 of the packing container. The triangular panel 6 is delimited from the side wall 1 by means of a crease line 7 and from the two triangular panels 5 by means of crease lines 8. The crease lines are of the conventional type, that is to say, they are constituted of linear compressions of the packing laminate produced earlier, e.g., during the manufacture of the material.

Between the two wall panels 5 and the upper surface 2 of the packing container (which may be regarded as consisting of two partial surfaces separated from one another by means of the sealing fin 3), weakening lines 9 are present which extend substantially in the direction from the corner 10 of the pouring spout connected to the upper wall 2 to the sealing fin 3 running centrally over the upper wall. The weakening lines 9 terminate at a small distance from the said corner 10 and the sealing fin 3, respectively, and may comprise, moreover, one or more partial lines that will be explained in more detail in the following. As is also shown in the figures, a base line 11 extending between the sealing fin 3 and the upper surface of the packing container 2 along the two wall panels 5 is in the form of a cutting line which line after opening of the packing container separates one end part of the sealing fin 3 from adjoining parts of the packing container. The cutting line may be constituted of an opening indication line or, e.g., a perforation. In this manner, opening of the packing container is made possible after the corner lug 4 forming the pouring spout has been folded up such that the front end of the sealing fin 3 is gripped between thumb and forefinger and torn off so that a pouring opening 12 is obtained.

The opening indication lines extend from one end of the sealing fin 3 to, or a little past, a point 13 located along the base line 11, substantially in the region where the upper panel 2 of the packing container passes into the panels 5 forming the pouring spout.

Figure 2:
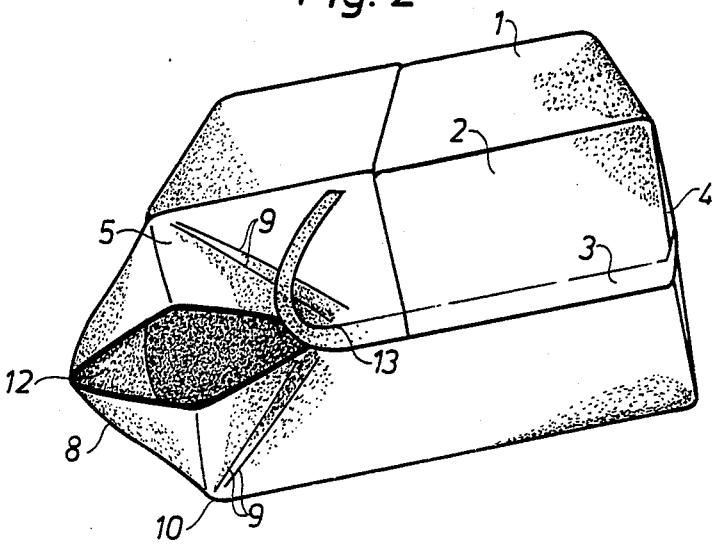
FIG. 2 shows the packing container in accordance with FIG. 1 from a different perspective.

When the packing container in accordance with the invention is to be opened, the folded down corner lug 4, which is intended for opening, is detached first from its position of sealed attachment to the side wall 1 of the packing container by breaking the seal between the surface 6 of the corner lug and folding the side wall 1 with one finger and the corner lug upward. Thereafter, the two triangular surfaces 5 are pressed toward one another at the same time the part of the transverse sealing fin 3 situated above the surfaces 5 is gripped. With the help of the opening indication line situated along a part of the base line 11 of the perforation fin, it is possible to subsequently tear apart the packing laminate in the transition area located between the triangular panels 5 and the sealing fin, thus forming the pouring opening 12. The torn up part of the sealing fin 3 can be folded backwards as shown in FIG. 2. Depending upon the rigidity and quality of the packing laminate, a pressure against the front triangular wall panel 6 is then required for the pouring spout to obtain the correct shape. This shape is obtained by folding the rear parts of the two triangular panels 5 upward upwards from their respective original positions to a position that is substantially level with the upper surface 2 of the packing container. The upward folding of the said parts of the panels 5 is realized by folding the packing laminate along the weakening lines 9 which lines extend in a direction from the corner 10 of the pouring spout connected to the upper wall 2 to the base line 11 of the sealing fin 3. The combined resistance against this folding is reduced appreciably in accordance with the invention in that the two weakening lines 9 extend toward the sealing fin 3 at unequal angles. That is to say, the weakening lines 9 or their imaginary extensions reach the sealing fin at two different points. Owing to this design, the elevation of the packing laminate in the weakening lines 9 will not occur simultaneously on the two sides of the sealing fin 3. More particularly, the weakening line 9 which runs at the more obtuse angle to the sealing fin 3 will serve first as a folding line and only afterward will the material be folded along the weakening line 9 located on the opposite side of the sealing fin 3 which runs at a more acute angle in relation to the sealing fin 3. Through this successive folding of the two halves of the upper container wall 2, a combined effect between the two wall halves that otherwise would render more difficult the formation of the pouring spout is: avoided. This design has been found in practice to appreciably facilitate the shaping of the pouring spout.

The design in accordance with the present invention comprising weakening lines 9 that extend at unequal angles has also been found to contribute to a better retention of the desired shape of the ready-shaped pouring spout. This shape retention is due to the packing laminate being bent more strongly along the two weakening lines 9 when these lines are not utilized at the same time. The previous risk of both two-part wall panels 5 being folded inward rather than outward during the outward folding of the pouring spout has been considerably reduced in accordance with the present invention.

Practical trials with the present invention indicate that the positive effects which are achieved by a displaced arrangement of the two weakening lines 9 is greatest when the weakening lines or their extensions arrive at the base line 11 of the sealing fin at two points situated at a distance amounting to ⅓–1/10 of the length of the lines 9. For reason of geometry, formation of the pouring spout at a greater distance along the length of the lines 9 becomes more difficult. Additionally, the spout tends to become crooked, whereas in the case of smaller distances, the positive effect is reduced to such a degree that the difference between packing containers in accordance with the invention and packing containers with conventional weakening lines becomes very small. The weakening lines 9 are preferably realized as crease lines or perforations that are provided in the carrier layer prior to the application of the watertight plastic layers of the laminate.

As shown in the figures, each weakening line 9 is preferably doubled so that it comprises one or more partial lines which run at a small mutual distance in the principal direction of the weakening line. As a result of this design, the folding is divided into a number of smaller partial foldings each of which further diminishes the force required for the folding and contributes to the maintenance of the outwardly folded wall surface 5 remaining in the desired position. As discussed above, the weakening lines 9 (whether they are single or double) extend substantially between the corner 10 and the base line 11 of the sealing fin 3. However, it is also possible to allow the weakening lines 9 to terminate at a small distance from the said corner 10 or the base line 11 of the sealing fin 3. This design facilitates manufacture, since it is usually difficult to make a great number of weakening lines meet at the same point. The relatively short distance which remains between the end point of the weakening line and the corner 10 or the base line 11, respectively, has been found to be of no significance for the formation of the pouring spout.

The arrangement in accordance with the present invention has been described in connection with a parallelepipedic packing container. However, this arrangement may also be used, in other types of packing containers having upper surfaces of essentially the same type as has been described. Thus, the invention is also applicable, for example, to packing containers of the so-called gable-top type, in which the upper surface or surfaces form in a ridge-like manner a greater or lesser angle to one another and the corner lugs are folded in under the two upper surfaces when the package is closed. It is also possible to use the invention in packing containers of the type that, when opened, the material layers sealed together in the sealing fin 3 are separate from one another manually or by some auxiliary means, e.g., a tearing element inserted in the sealing fin in the form of a cord or the like. The arrangement in accordance with the invention is thus applicable to a number of different types of packing containers and provides an optimum solution to the problem of forming and retaining a safely functioning pouring spout.

What is claimed is:

1. A packing container of substantially parallelpipedic shape including an upper wall, a sealing fin extending over said upper wall and dividing said upper wall into first and second upper wall portions positioned on opposite sides of said sealing fin from one another, and an opening arrangement, said opening arrangement comprising: a fold-out pouring spout having first and second spout panels on opposite sides of said sealing fin from one another, said first and second spout panels bordering said first and second upper wall portions, respectively, first linear weakening means for forming at least one first fold-line between said first spout panel and said first upper wall portion when said spout is folded-out and second linear weakening means for forming at least one second fold-line between said second spout panel and said second upper wall portion when said spout is folded-out, said first and second linear weakening means positioned on opposite sides of said sealing fin from one another, said first spout panel being delimited from said first upper wall portion by said first linear weakening means which extends from a corner of said packing container adjacent said first spout panel and said first upper wall portion toward said sealing fin, said first linear weakening means being at a first angle with respect to said sealing fin, said second spout panel being delimited from said second wall portion by said second linear weakening means which extends from a corner of said packing container adjacent said first spout panel and said second upper wall portion toward said sealing fin, said second linear weakening means being at a second angle with respect to said sealing fin, said first and second angles being unequal to each other, whereby the unequal angular relationship of said first and second linear weakening means promotes successive initiation of folding of said first and second linear weakening means so as to facilitate the opening of said spout.

2. The packing container in accordance with claim 1 wherein said first and second linear weakening means each form a single fold-line.

3. The packing container in accordance with claim 1 wherein said first and second linear weakening means each form a pair of fold-lines.

4. The packing container in accordance with claim 1, wherein each first and second linear weakening means extends between the respective corner of the packing container and a base line of the sealing fin.

5. The packing container in accordance with claim 1, wherein said first and second linear weakening means terminate short of the respective corner of the packing container and short of a base line of the sealing fin.

6. The packing container in accordance with claim 1, wherein said first and second linear weakening means define first and second points of intersection with said sealing fin, respectively, said first and second points being separated from one another by a distance in the range of ⅓–1/10 of the length of said linear weakening means.

7. The packing container in accordance with claim 6, wherein each first and second linear weakening means extends between the respective corner of the packing container and a base line of the sealing fin.

8. The packing container in accordance with claim 6, wherein said first and second linear weakening means terminate short of the respective corner of the packing container and short of a base line of the sealing fin.

9. The packing container in accordance with claim 6, wherein said first and second linear weakening means are crease lines.

10. A packing container in accordance with claim 6, wherein said first and second weakening means are perforations.

11. The packing container in accordance with claim 1, wherein said first and second linear weakening means are crease lines.

12. The packing container in accordance with claim 11, wherein each first and second linear weakening means extends between the respective corner of the packing container and a base line of the sealing fin.

13. The packing container in accordance with claim 11, wherein said first and second linear weakening means terminate short of the respective corner of the packing container and short of a base line of the sealing fin.

14. The packing container in accordance with claim 1, wherein said first and second linear weakening means are perforations.

15. The packing container in accordance with claim 14, wherein each first and second linear weakening means extends between the respective corner of the packing container and a base line of the sealing fin.

16. The packing container in accordance with claim 11, wherein said first and second linear weakening means terminate short of the respective corner of the packing container and short of a base line of the sealing fin.

17. The packing container in accordance with claims 1, 6, 11 or 14, wherein said first and second linear weakening means include interrupted lines.

18. The packing container in accordance with claim 17, wherein each first and second linear weakening means extends between the respective corner of the packing container and a base line of the sealing fin.

19. The packing container in accordance with claim 17, wherein said first and second linear weakening means terminate short of the respective corner of the packing container and short of a base line of the sealing fin.

* * * * *